US007134490B2

(12) United States Patent
Nguyen

(10) Patent No.: US 7,134,490 B2
(45) Date of Patent: Nov. 14, 2006

(54) THROUGH BORE WELLHEAD HANGER SYSTEM

(75) Inventor: Dennis P. Nguyen, Houston, TX (US)

(73) Assignee: Cameron International Corporation, Houston, TX (US)

( * ) Notice: Subject to any disclaimer, the term of this patent is extended or adjusted under 35 U.S.C. 154(b) by 185 days.

(21) Appl. No.: 10/767,162

(22) Filed: Jan. 29, 2004

(65) Prior Publication Data

US 2005/0167095 A1 Aug. 4, 2005

(51) Int. Cl.
*E21B 33/04* (2006.01)

(52) U.S. Cl. ..... 166/208; 166/217

(58) Field of Classification Search ..... 166/208, 166/217, 382, 77.51, 75.14
See application file for complete search history.

(56) References Cited

U.S. PATENT DOCUMENTS

| | | | | |
|---|---|---|---|---|
| 4,262,748 A | | 4/1981 | Kirkland | 166/348 |
| 4,416,472 A | * | 11/1983 | Fowler et al. | 285/3 |
| 4,595,063 A | | 6/1986 | Jennings et al. | 166/382 |
| 5,031,696 A | | 7/1991 | Zwiegel | |
| 5,209,521 A | * | 5/1993 | Osborne | 285/3 |
| 5,236,037 A | | 8/1993 | Watkins | 166/89 |
| 5,327,965 A | * | 7/1994 | Stephen et al. | 166/208 |
| 5,725,056 A | * | 3/1998 | Thomson | 166/382 |
| 6,065,542 A | * | 5/2000 | Lalor et al. | 166/348 |
| 6,598,673 B1 | * | 7/2003 | Hosie et al. | 166/208 |
| 2002/0074124 A1 | | 6/2002 | Cunningham et al. | 166/348 |
| 2002/0100596 A1 | * | 8/2002 | Nguyen et al. | 166/382 |

FOREIGN PATENT DOCUMENTS

| | | |
|---|---|---|
| GB | 2 208 123 A | 1/1989 |
| GB | 2 230 035 A | 10/1990 |

* cited by examiner

*Primary Examiner*—William Neuder
(74) *Attorney, Agent, or Firm*—Peter Bielinski

(57) ABSTRACT

A wellhead hanger system that allows the use of either of two casing hangers depending upon whether the casing string to be suspended becomes stuck during installation and cannot be lowered to its expected depth is disclosed. A full bore test plug for use with the system is disclosed also.

23 Claims, 8 Drawing Sheets

THROUGH BORE WELLHEAD HANGER SYSTEM

BACKGROUND OF THE INVENTION

1. Field of the Invention

This invention relates to a wellhead system to allow an operator the option to suspend casing within the wellhead housing using either a casing hanger with a threaded lower connection or a casing hanger with a plurality of slip segments for suspending the casing. Additionally, the casing hangers utilize either an expandible load ring or a plurality of moveable load segments on their exterior to transfer the load of the suspended casing from the casing hanger to the wellhead housing. Such a system allows an operator to handle situations in which the casing may stick in the well bore before being lowered fully into position and require the casing to be cut off and thereby require the use of a slip type hanger.

As more oil wells are drilled and produced from conventional fixed bottom platforms or tension leg platforms, operators wish to minimize the size of the wellhead assemblies commonly referred to as Christmas trees on these platforms. Operators also wish to squeeze more wells into tighter spacing arrangements to minimize the size of the platforms and therefore their costs. This desire to minimize the size of Christmas trees and minimize the spacing of well bores has imposed the requirement of using smaller blowout preventers for drilling a given size casing hole. This requirement poses difficulties for wellhead system designers who require certain minimum size blowout preventers to allow the casing hangers and seal assemblies to be lowered through the blowout preventer during installation.

These requirements of minimization have necessitated wellhead designers to develop innovative ways to suspend the plurality of concentric casing strings within a wellhead housing while maintaining proper vertical spacing between the tops of the casing strings to allow seal assemblies to be installed and allow access to the annuli between adjacent casing strings. In typical wellhead system installations, this is not a problem as the casing string to be suspended is able to be lowered into position with the last or topmost casing joint threaded into a mandrel type casing hanger which comes to rest on a mating shoulder in the wellhead housing. In the event that the casing becomes stuck in the well bore before the full length of casing can be lowered into the well bore, a typical solution has been to use a slip type hanger that utilizes a plurality of tapered wedges or "slips", as commonly known in the industry, to encircle the casing and suspend the casing in a tapered bowl formed on the interior of the wellhead housing. This type of installation however, typically required substitution of a special casing hanger and/or wellhead housing. This was a logistical and operational nightmare for the operator.

Additionally, these special hangers and wellhead housings were often bigger than the standard assemblies therefore taking up more space. These various limitations run directly contrary to the requirement of minimization mentioned above, particularly in regard to the requirement to minimize spacing between well bores and allow the use of smaller size blowout preventers. It is therefore desirable to have a wellhead system that allows minimizing the spacing between well bores, the use of the smallest size blowout preventer possible and allows for the contingency of casing strings that may become stuck during installation and require cutting of the casing string prematurely. The wellhead assembly of the present invention offers a substantial improvement by offering a wellhead housing and a pair of casing hangers that allows minimization of well bore spacing and the use of the smallest size blowout preventer.

2. Description of Related Art

U.S. Pat. No. 4,262,748 to K. G. Kirkland shows a multiple string well completion system for subsea wellheads that tubing strings to be installed independently. The use of expanding segmented hangers for suspension of some casing strings is disclosed.

A subsea casing hanger suspension system is disclosed in U.S. Pat. No. 4,595,063 to C. E. Jennings et al. Load ring slips that are radially expanded into mating wellhead housing grooves for suspension of casing strings are shown.

U.S. Pat. No. 5,236,037 to B. J. Watkins shows a unitized wellhead system with seal assemblies sealing on a tapered neck of the casing hanger to allow annulus monitoring.

A concentric tubing completion system utilizing a ratcheting lock mechanism is disclosed in U.S. Patent Application Publication No. US 2002/0074124 A1 to C. E. Cunningham M. Childers et al.

UK Patent Application No. 2 208 123 A to M. Mcintosh discloses a wellhead assembly utilizing expanding type hangers to suspend casing and tubing.

SUMMARY OF THE INVENTION

The casing hanger system of the present invention is designed to allow an operator the option to suspend casing within the wellhead housing using either a casing hanger with a threaded lower connection or a casing hanger with a plurality of slip segments for suspending the casing. Additionally, the casing hangers utilize either an expandible load ring or a plurality of moveable load segments on their exterior to transfer the load of the suspended casing from the casing hanger to the wellhead housing. Such a system allows an operator to handle situations in which the casing may stick in the well bore before being lowered fully into position and require the casing to be cut off and thereby require the use of a slip type hanger.

One of the casing hangers is designed for those instances in which the casing to be suspended may become stuck in the well bore before the full length of casing can be lowered completely into the well bore. This casing hanger includes a hanger body having a bore extending therethrough and a tapered hanger bowl to receive a plurality of slip segments. The hanger body has a stepped outer shoulder which is stepped to receive a plurality of load segments thereon. The plurality of load segments are axially moveable between a first, contracted position that allows the casing hanger to pass through a specified minimum bore and a second, expanded position where the casing hanger is suspended on the plurality of load segments when the plurality of load segments are urged radially outwardly to engage a annular groove in a wellhead housing. An actuation ring moves the load segments moved between the contracted and expanded positions by engaging a shoulder in the wellhead housing.

The slip segments are shaped on their exterior to engage the tapered hanger bowl and on their interior to grip the casing to be suspended. The slip segments include teeth formed on their exterior to grip the hanger bowl and teeth on their interior to grip the casing as the slip segments move coaxially with respect to the tapered hanger bowl and grip the casing. Additionally, the hanger body may be separated into a plurality of bowl sections to allow installing the casing hanger around the section of casing to be suspended in the wellhead housing.

The other casing hanger is designed for those situations in which the operator experiences no difficulty in lowering the casing to be suspended into the well bore and the hanger can be lowered with the casing attached to its lower end into position adjacent an annular groove in the wellhead housing. This casing hanger has a bore extending therethrough and a stepped outer shoulder configured to receive an expandible load ring thereon. The expandible load ring is axially moveable between a first, contracted position allowing the casing hanger to pass through the wellhead housing bore and a second, expanded position where the casing hanger is suspended on the expandible load ring when the expandible load ring engages an annular groove in the wellhead housing. The expandible load ring is moved between the contracted and expanded positions by engagement of an actuation ring with a shoulder in the wellhead housing.

These two type of casing hangers form the basis of a wellhead system for suspending a plurality of concentric casing strings in a wellhead including a wellhead housing having a bore therethrough with a shoulder at its lower end and at least one annular groove axially spaced from the shoulder. The wellhead housing has a plurality of side outlets within bore that are axially spaced from the shoulder. Either of the two aforementioned casing hangers may be used to suspend casing from the wellhead housing. An operator has the option of using either casing hanger depending upon what conditions are encountered during running of the casing string into the well bore. Either of the casing hangers maintains the proper axial spacing within the wellhead body so a packoff seal assembly may be installed to seal the annulus without affecting the positioning of subsequent casing hangers and packoff assemblies. This ensures the aforementioned side outlets can be used for accessing and monitoring the casing annuli.

A principal object of the present invention is to provide a wellhead system that allows the use of either of two casing hangers depending upon whether the casing string to be suspended becomes stuck during installation and cannot be lowered to its expected depth.

Another object of the present invention is to provide a casing hanger that allows the use of a minimum sized blowout preventer for drilling operations while maintaining full bore access through the wellhead housing bore.

A final object of the present invention is to provide a second casing hanger for situations when the casing becomes stuck during running that preclude the use of a conventional casing hanger and the second casing hanger can maintain the original spacing of casing hangers and packoff assemblies in a wellhead housing.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
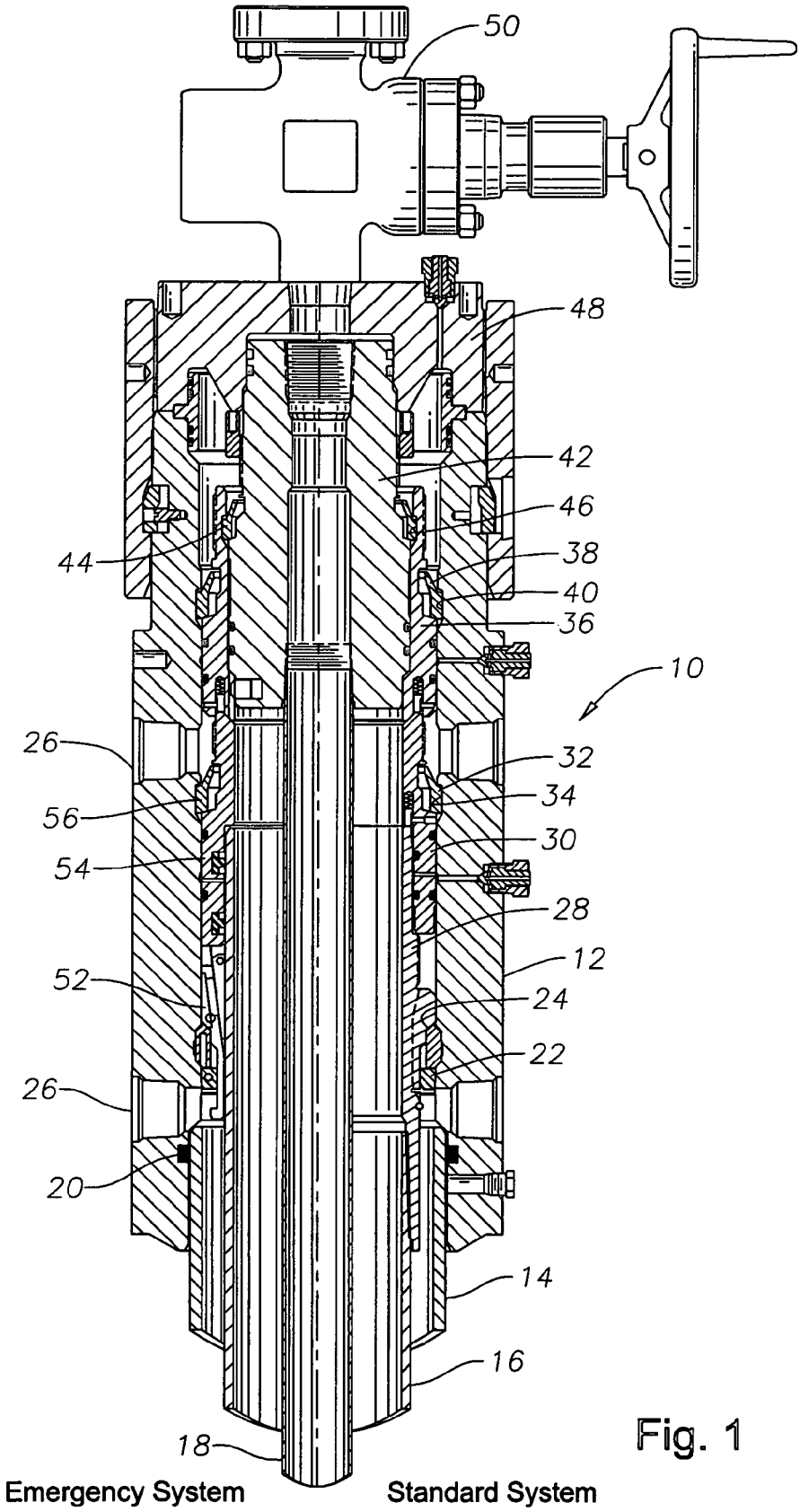
FIG. 1 comprises a sectional view of a wellhead system with the right half of the view showing a combination of standard casing hangers and packoff assemblies and the left half of the view showing a combination of casing hangers and packoff assemblies for emergency situations in which the casing sticks in the well bore while being lowered into position.

With reference to the drawings, and particularly to FIG. 1 a sectional view of a wellhead system 10 is shown with the right half of the view showing a combination of standard casing hangers and packoff assemblies and the left half of the view showing a combination of emergency casing hangers and packoff assemblies. The term "standard" as used in this application with reference to the casing hangers and packoff assemblies used therewith refers to the situation in which a hole is drilled to receive a casing string, the casing string is lowered into the drilled hole with the casing hanger secured to the top joint of casing and the casing hanger is landed in the wellhead housing. The term "emergency" as used in this application with reference to the casing hangers and packoff assemblies used therewith refers to the situation in which a hole is drilled to receive a casing string, the casing string is lowered into the drilled hole and the casing becomes stuck in the drilled hole. This situation requires the casing string to be cut off and a slip type casing hanger (as will be disclosed in this application) to be used to support the casing string in the wellhead housing.

Wellhead system 10 includes wellhead housing 12 with casing strings 14 and 16 and tubing string 18 suspended therein. Although wellhead system 10 is shown with two casing strings and one tubing string, other combinations of casing and tubing strings could be used as dictated by well bore conditions without departing from the scope of the present invention. As seen in FIG. 1, outer casing string 14 is secured to the lower end of wellhead housing 10 by suitable means as welding. Seal ring 20 seals casing string 14 to wellhead housing 10. Wellhead housing 10 is a generally cylindrical member with shoulder 22 disposed near its lower end. Annular groove 24 is adjacent shoulder 22 for purposes to be shown hereinafter. A plurality of side outlets 26 are spaced axially within wellhead housing 10 from shoulder 22 for monitoring and accessing casing and tubing annuli as is well known in the art.

Wellhead casing hanger 28 as used in the standard system is shown landed in wellhead housing 10 with casing string 16 secured to its lower end. Packoff assembly 30 is installed above wellhead casing hanger 28 and seals the annulus between wellhead casing hanger 28 and wellhead housing 10. Packoff assembly 30 is secured within wellhead housing 10 by split ring 32 engaging annular groove 34 in wellhead housing 10. Tubing annulus packoff assembly 36 is landed on packoff assembly 30 and is secured within wellhead housing 10 by split ring 38 engaging annular groove 40 in wellhead housing 10. Tubing hanger 42 is seated on tubing annulus packoff assembly 36 with tubing string 18 secured to its lower end. Tubing hanger 42 is secured to tubing annulus packoff assembly 36 by split ring 44 engaging annular groove 46 on the interior of tubing annulus packoff assembly 36. The upper end of wellhead housing 10 is sealed by mechanical connector 48 with master valve 50 secured thereon.

Wellhead casing hanger 52 as used in the emergency system is shown landed in wellhead housing 10 with casing string 16 suspended therefrom by means to be discussed hereinafter. Packoff assembly 54 is installed above wellhead casing hanger 28 and seals the annulus between wellhead casing hanger 52 and wellhead housing 10. Packoff assembly 54 is secured within wellhead housing 10 by split ring 56 engaging annular groove 34 in wellhead housing 10. Tubing annulus packoff assembly 36 is landed on packoff assembly 52 and is secured within wellhead housing 10 by split ring 38 engaging annular groove 40 in wellhead housing 10. Tubing hanger 42 and mechanical connector 48 are installed and secured within wellhead housing 10 as in the standard system. It is important to note that wellhead casing hanger 52 allows the suspension of casing string 16 within wellhead housing 10 after being cut off while maintaining the appropriate positioning of packoff assembly 52 relative to side outlets 26, i.e., the "stackup height" as commonly referred to in the industry, to allow annulus monitoring through side outlets 26. Additionally, this arrangement allows subsequent installation of standard tubing annulus packoff assembly 36 and tubing hanger 42 without requiring any additional modifications.

Figure 2:
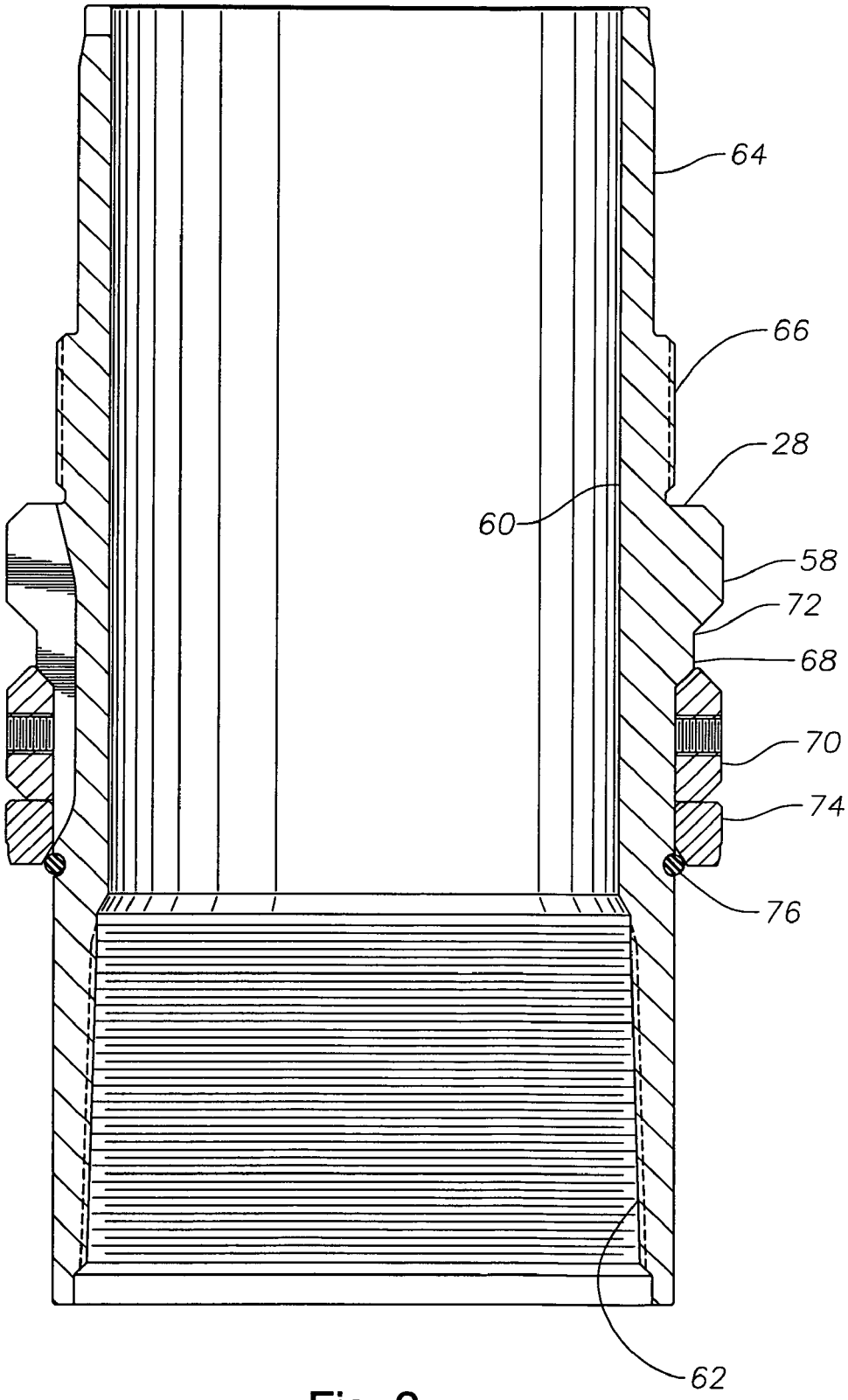
FIG. 2 comprises an enlarged sectional view of the standard casing hanger.

The details of construction of wellhead casing hanger 28 are best seen in FIG. 2. Wellhead casing hanger 28 includes hanger body 58 with bore 60 extending therethrough. Lower interior thread 62 allows attachment of the casing string to be suspended. The opposite exterior end has reduced exterior diameter 64 to receive packoff assembly 30 with exterior thread 66 adjacent for attachment of a running tool. Hanger body 58 has stepped outer shoulder 68 formed thereon with expandible load ring 70 thereon. Cylindrical retainer surface 72 is formed as part of stepped outer shoulder 68 and is concentric with the axis of hanger body 58. Expandible load ring 70 is shown in its contracted position that allows it and hanger body 58 to pass through the bore of wellhead housing 12. Actuation ring 74 is positioned adjacent expandible load ring 70 and is held on hanger body by snap ring 76.

Figure 3:
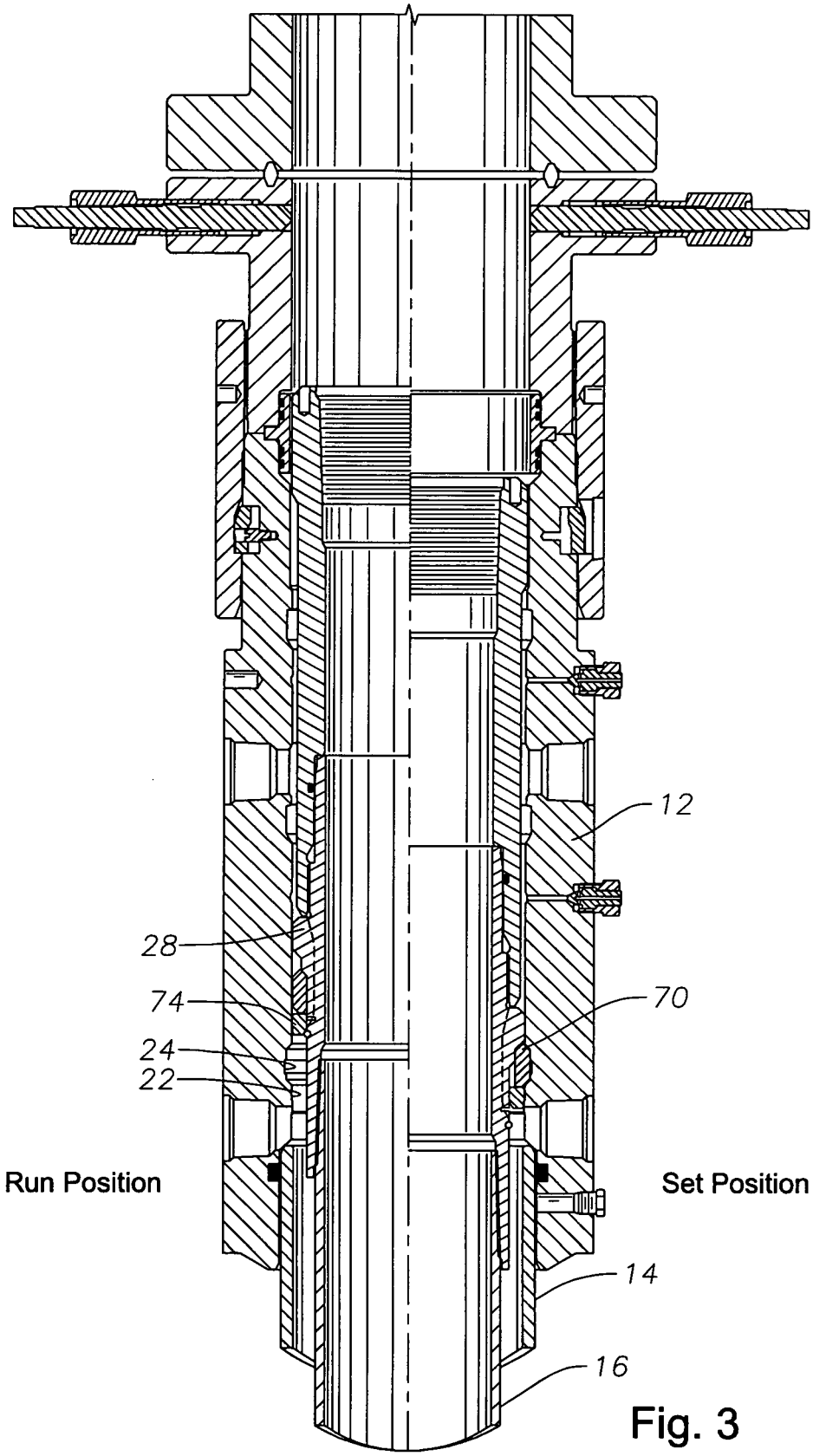
FIG. 3 comprises a sectional view of the standard casing hanger with the left half of the view showing the standard casing hanger immediately prior to landing in the wellhead housing and the right half of the view showing the casing hanger landed and the expandible load ring engaging an annular groove in the wellhead housing.

The details of the landing of wellhead casing hanger 28 are shown in FIG. 3. The left side of FIG. 3 shows wellhead casing hanger 28 immediately prior to landing and the right side shows wellhead casing hanger 28 landed in wellhead housing 12. As wellhead casing hanger 28 approaches shoulder 22, actuation ring 74 engages shoulder 22 and is urged upward against expandible load ring 70. As wellhead casing hanger 28 in lowered further, expandible load ring 70 opens to its expanded position in annular groove 24 and moves onto cylindrical retainer surface 72 where it comes to rest. At this point the load of casing string 16 is borne on expandible load ring 70 and annular groove 24. Packoff assembly 30 is then run into position in a manner well known to those of ordinary skill in the art.

Figure 4:
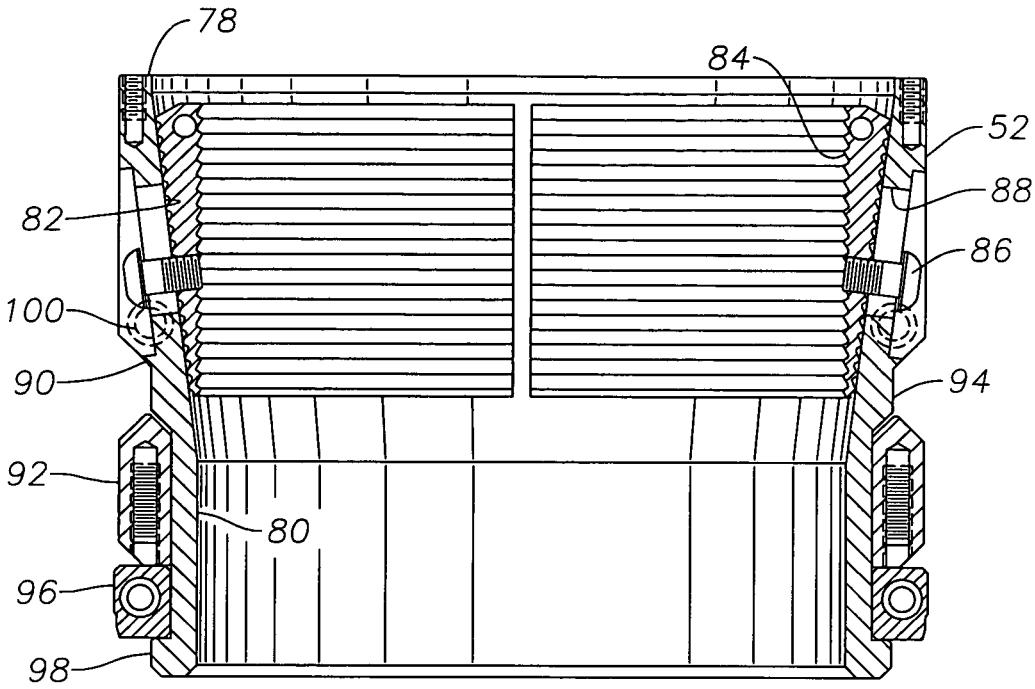
FIG. 4 comprises a sectional view of the emergency casing hanger.
Figure 5:
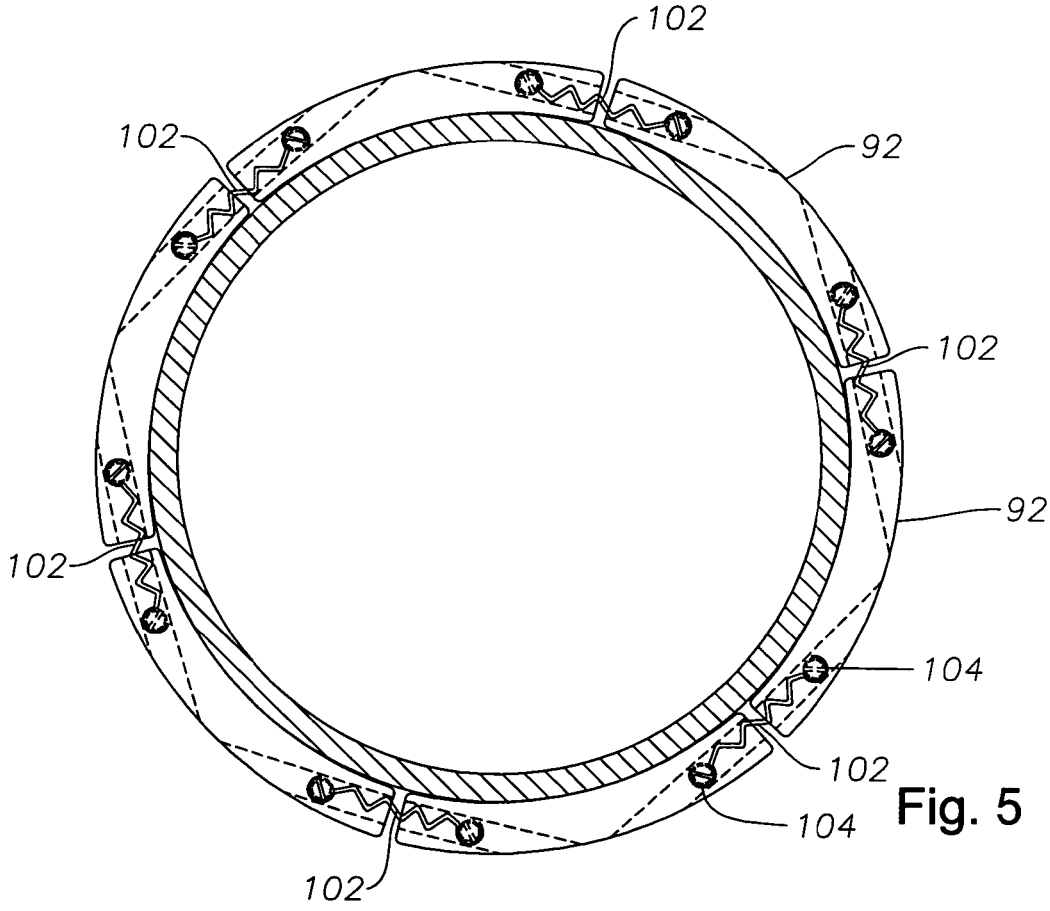
FIG. 5 comprises a plan view of the load segments of the emergency casing hanger.
Figure 6:
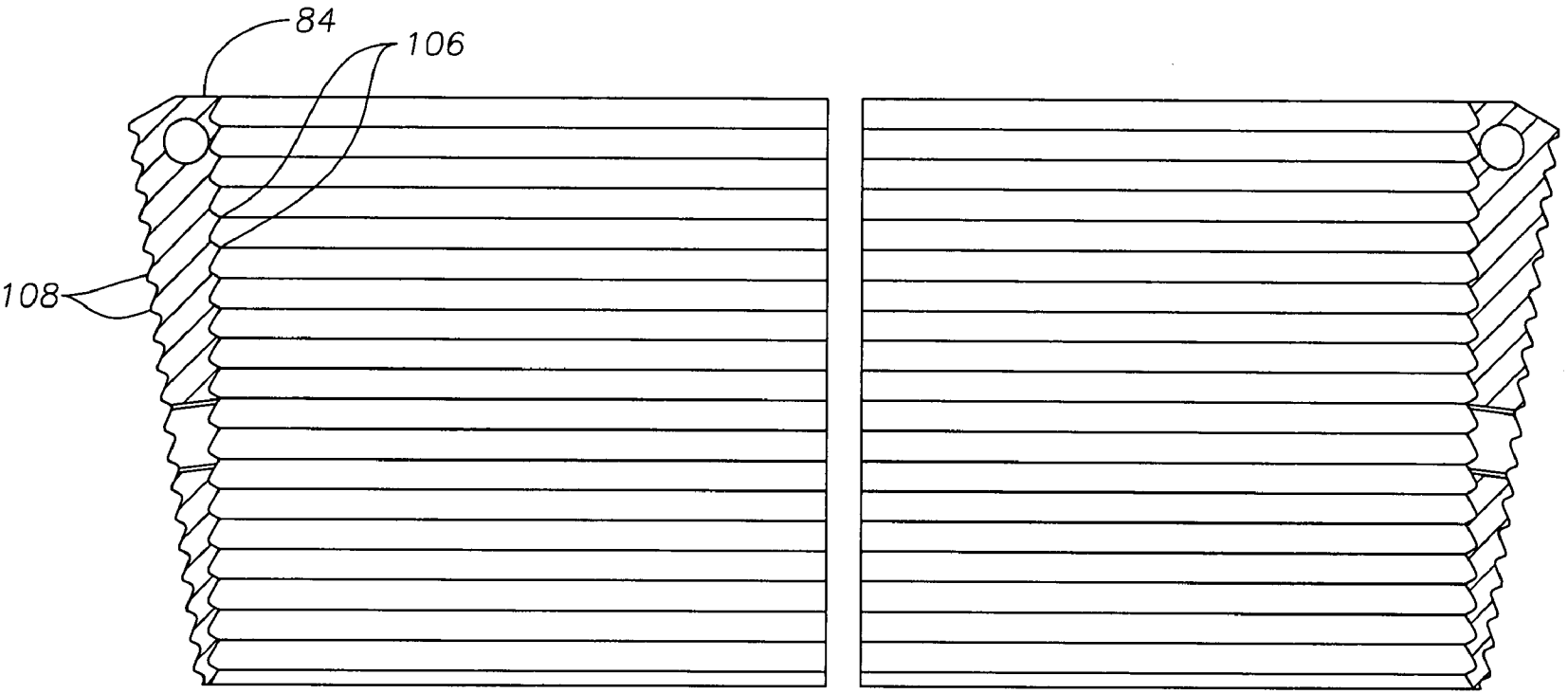
FIG. 6 comprises a sectional view of the slip segments showing details of the teeth.

The details of construction of wellhead casing hanger 52 are best seen in FIGS. 4, 5 and 6. Wellhead casing hanger 52 is the emergency casing hanger to be used when the casing string becomes stuck during installation. Wellhead casing hanger 52 includes hanger body 78 with bore 80 extending therethrough. Tapered hanger bowl 82 is formed on the interior of hanger body 78 and intersects hanger bore 78. Slip segments 84 sit in tapered hanger bowl 82 and are held in place by retaining means in the form of cap screws 86 that engage axially disposed slots 88 in hanger body 78. Movement of cap screws 86 in slots 88 controls movement of slip segments 84 along tapered hanger bowl 82 into gripping engagement with the casing or pipe to be suspended by wellhead head hanger 52.

Hanger body 78 has stepped outer shoulder 90 formed on the exterior with load segments 92 retained thereon. Cylindrical retainer surface 94 is formed as part of stepped outer shoulder 90 and is concentric with the axis of hanger body 78. Load segments 92 are shown in their contracted position that allow them and hanger body 78 to pass through the bore of wellhead housing 12. Actuation ring 96 is positioned adjacent load segments 92 and is held on hanger body 78 by lower lip 98. Actuation ring 96 is formed in two halves that are bolted by cap screws 100 to form the ring. Additionally, hanger body 78 is formed in two bowl sections or halves that are secured together by cap screws 102. The ability to split hanger body 78, slip segments 84, load segments 92 and actuation ring 96 into two or more sections allows wellhead casing hanger 52 to be installed around pipe or casing in a manner to be described hereinafter.

Details of the means to retain load segments 92 on hanger body 78 are shown in FIG. 5. Load segments 92 are arranged in a circle as shown with urging means in the form of tension coil springs 102 secured between adjacent load segments. Coil springs 102 are attached to individual load segments by suitable means as cap screws 104. When assembled as shown onto hanger body 78 in the position shown in FIG. 4, coil springs 102 retain load segments 92 in the aforementioned contracted position.

A pair of slip segments 84 are shown in FIG. 6 in an enlarged view to show details of their construction. A plurality of teeth 106 are formed on the interior of slip segments 84 and beveled to grip the pipe or casing to be suspended within wellhead casing hanger 52. A plurality of teeth 108 formed on the exterior of slip segments 84 are beveled to remain perpendicular to tapered hanger bowl 82 as slip segments 84 are moved radially inwardly.

Figure 7:
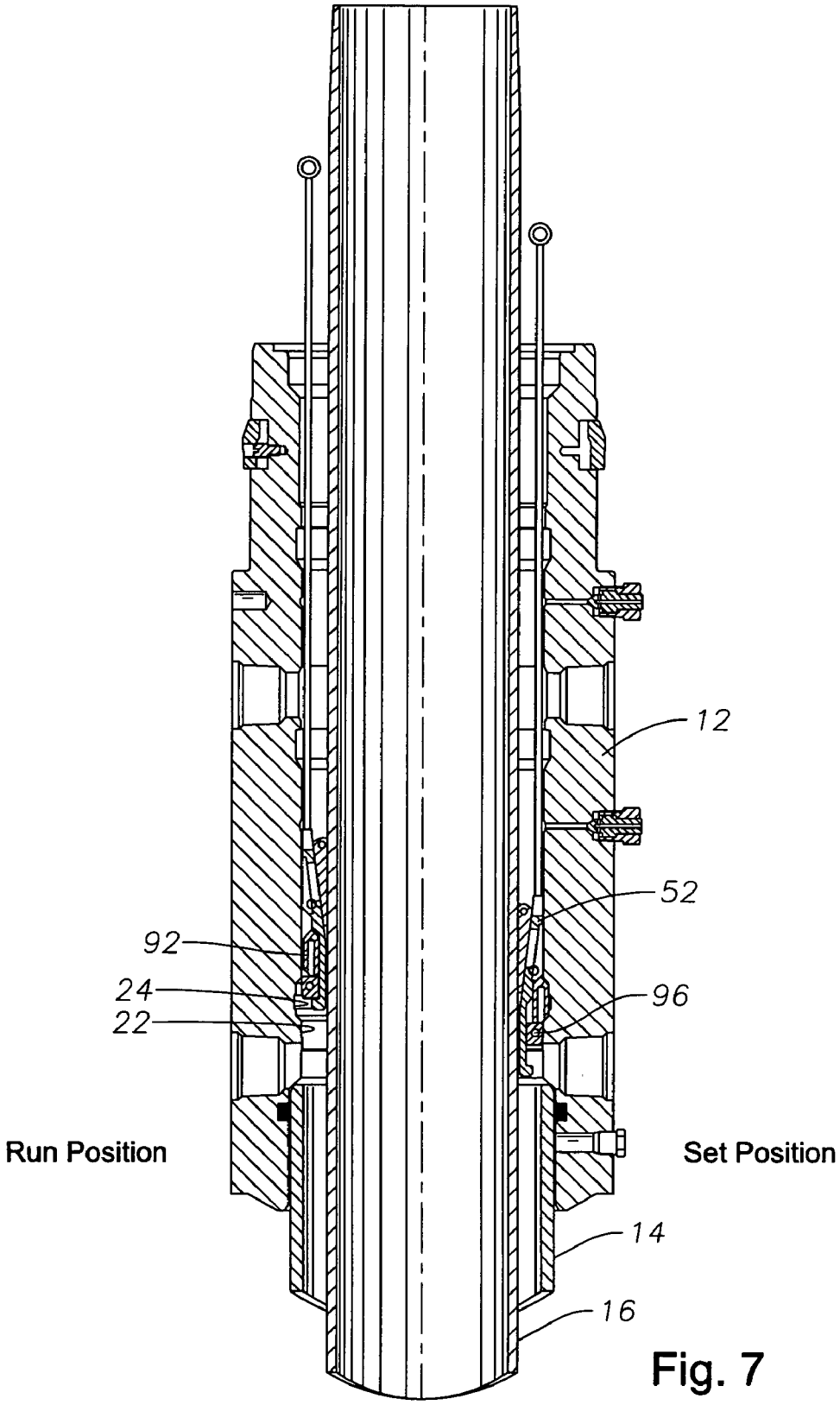
FIG. 7 comprises a sectional view of the emergency casing hanger with the left half of the view showing the emergency casing hanger immediately prior to landing in the wellhead housing and the right half of the view showing the casing hanger landed and the load segments engaging an annular groove in the wellhead housing and the slip segments gripping the casing string.

The details of the landing of wellhead casing hanger 52 are shown in FIG. 7. The left side of FIG. 7 shows wellhead casing hanger 52 immediately prior to landing and the right side shows wellhead casing hanger 52 landed in wellhead housing 12 with casing string 16 suspended therefrom. Once it is determined that casing string 16 has become stuck and emergency wellhead casing hanger 52 will be required, casing string 16 is cut to the desired height and casing hanger 52 is installed around casing string 16 as previously described. As emergency wellhead casing hanger 52 approaches shoulder 22, actuation ring 96 engages shoulder 22 and is urged upward against load segments 92. As emergency wellhead casing hanger 52 is lowered further, load segments 92 are opened to their expanded position in annular groove 24 and move onto cylindrical retainer surface 94 where they come to rest. At this point the load of casing string 16 is lowered thereby allowing slip segments 84 to move axially and radially inwardly along tapered hanger bowl 82 to grip casing string 16 and suspend casing string 16 within emergency wellhead casing hanger 52. The weight of casing string 16 is thereby transferred onto load segments 92 and annular groove 24. Packoff assembly 54 is then run into position in a manner well known to those of ordinary skill in the art. At this point well drilling and completion operations may continue as though the standard system were in place.

Figure 8:
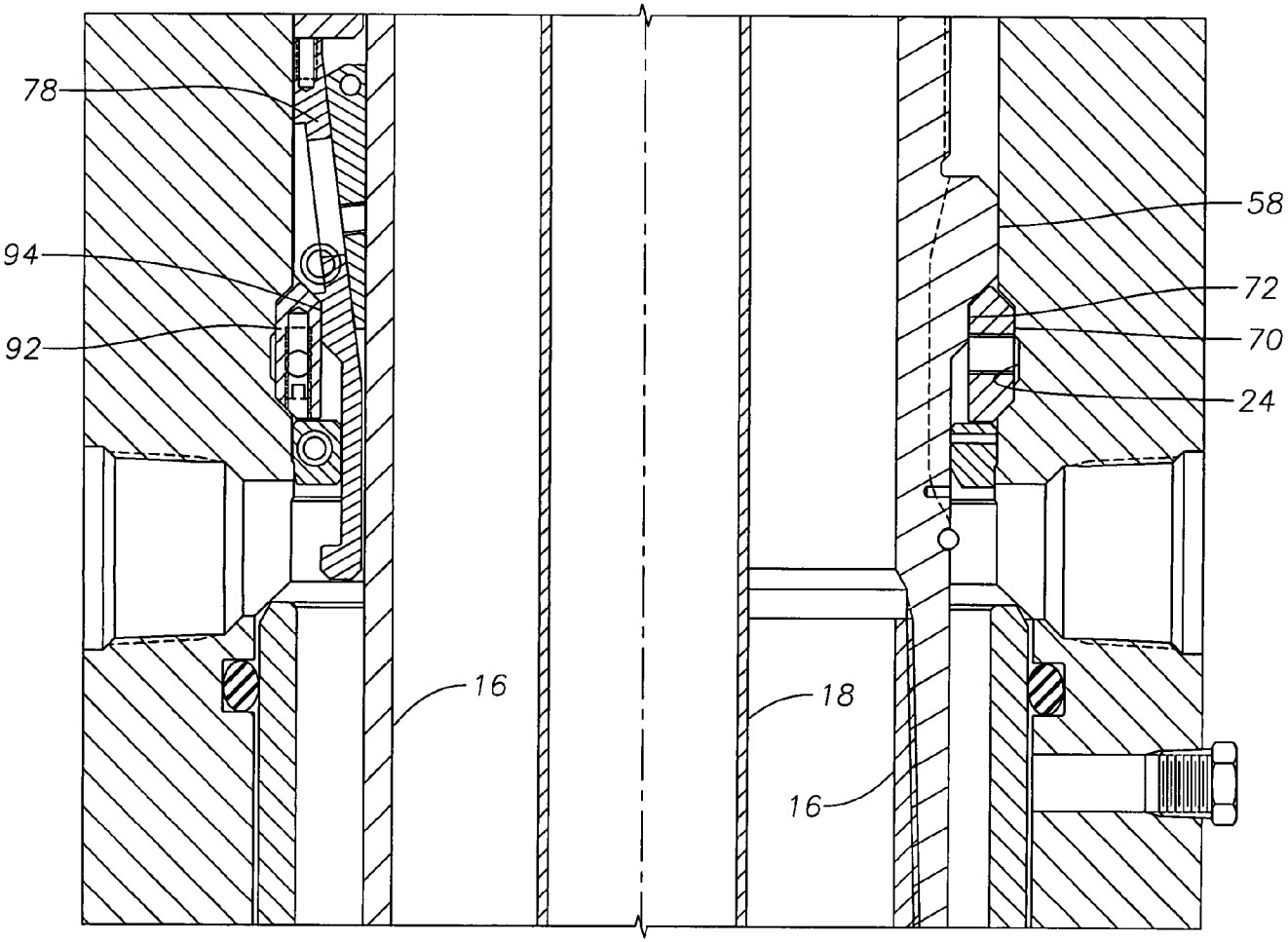
FIG. 8 comprises a partial sectional view of a wellhead system with the right half of the view showing a standard casing hanger with its expandible ring being supported in the annular groove of the wellhead housing by the cylindrical exterior of the hanger body and the left half of the view showing an emergency casing hanger with its expandible load segments being supported in the annular groove of the wellhead housing by the cylindrical exterior of the hanger body. segments gripping the casing string.

FIG. 8 shows details of how the cylindrical retainer surfaces of the casing hanger bodies act to support and positively retain the expandible load ring or load segments in position. FIG. 8 is a partial sectional view of wellhead system 10 with the right half of the view showing standard casing hanger 28 with expandible load ring 70 being supported in annular groove 24 of wellhead housing 12 by cylindrical retainer surface 72 of hanger body 58. The left half of the view of FIG. 8 shows emergency casing hanger 52 with expandible load segments 92 being supported in annular groove 24 of wellhead housing 12 by cylindrical retainer surface 94 of hanger body 78.

Figure 9:
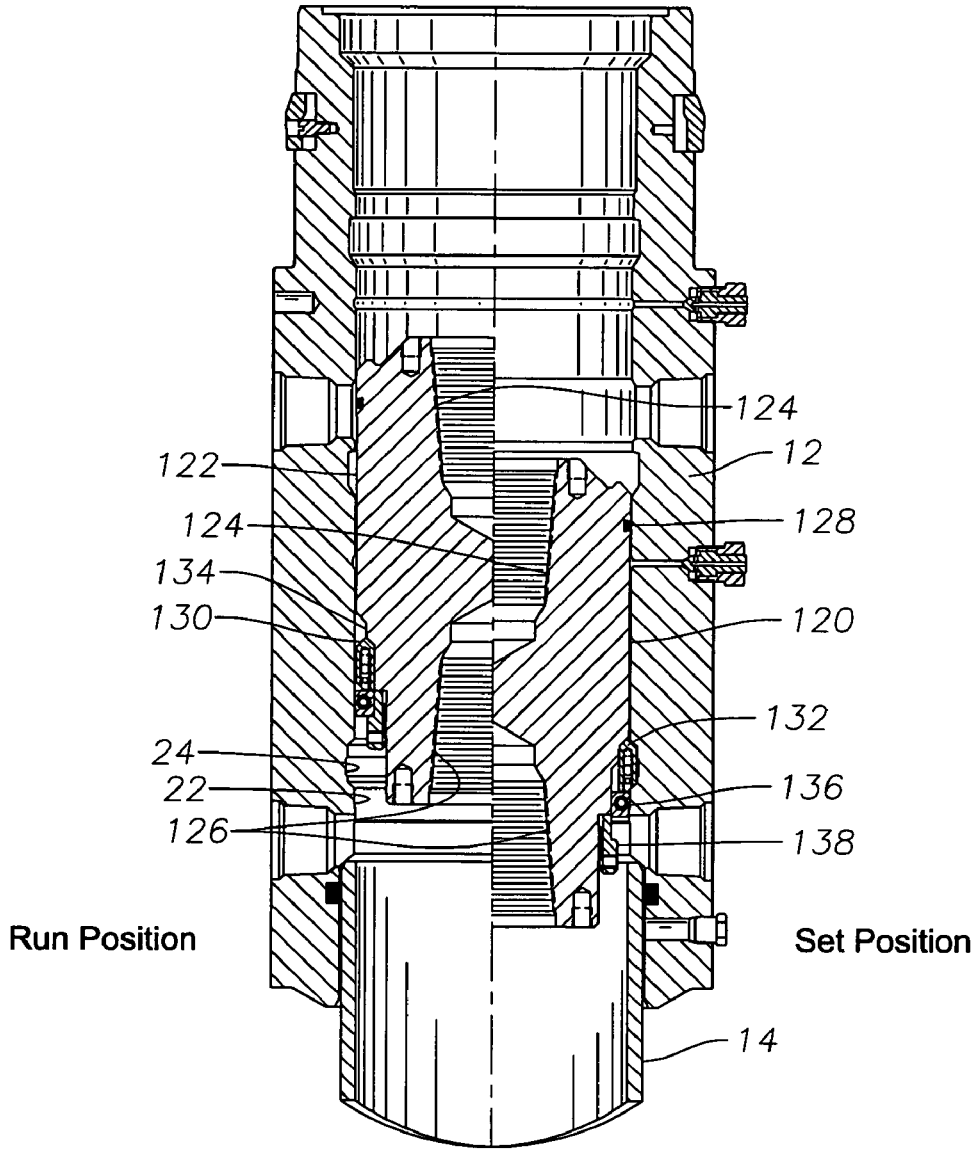
FIG. 9 comprises a sectional view of a full bore test plug for testing blowout preventers in the wellhead system of the present invention with the left half of the view showing the full bore test plug immediately prior to landing in the wellhead housing and the right half of the view showing the full bore test plug landed and the load segments engaging an annular groove in the wellhead housing.

FIG. 9 shows the construction and landing of a full bore test plug for use with the wellhead system of the present invention. The left half of FIG. 9 shows the full bore test plug immediately prior to landing in the wellhead housing and the right half of the view shows the full bore test plug landed and the load segments engaging an annular groove in the wellhead housing. Full bore test plug 120 includes test plug body 122 with upper and lower threaded connections 124 and 126, respectively. Upper and lower threaded connections 124 and 126 allow the attachment of drill pipe handling strings to test plug body 122 in a manner well known to those of ordinary skill in the art. Test plug body 122 is a solid cylindrical member with seal ring 128 positioned on its exterior adjacent its upper end.

Test plug body 122 has stepped outer shoulder 130 formed on the exterior with load segments 132 retained thereon, analogous to the aforementioned hanger. Cylindrical retainer surface 134 is formed as part of stepped outer shoulder 130 and is concentric with the axis of test plug body 122. Load segments 132 are shown in their contracted position that allow them and test plug body 122 to pass through the bore of wellhead housing 12. Actuation ring 136 is positioned adjacent load segments 132 and is held on test plug body 122 by lower lip 138.

The means to retain load segments 132 on test plug body 122 are the same as in the case of the emergency casing hanger. Load segments 132 are arranged in a circle with urging means in the form of tension coil springs 102 (not shown) secured between adjacent load segments. Coil springs 102 are attached to individual load segments 132 by suitable means as cap screws and coil springs 102 retain load segments 132 in the aforementioned contracted position. The landing of test plug 120 in wellhead body 12 and actuation of load segments 132 to engage groove 24 is the same as in the emergency casing hanger 52. When test plug 120 is landed and load segments 132 are fully engaged in groove 24, a full bore test of a blowout preventer may be performed without damage to wellhead body 12 or test plug 120.

The construction of my wellhead hanger system will be readily understood from the foregoing description and it will be seen that I have provided a wellhead hanger system that allows the use of either of two casing hangers depending upon whether the casing string to be suspended becomes stuck during installation and cannot be lowered to its expected depth. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A wellhead casing hanger, comprising:

a hanger body, said hanger body having a bore extending therethrough and a tapered hanger bowl to receive a plurality of slip segments therein;

said hanger body having a stepped outer shoulder, said stepped outer shoulder configured to receive a plurality of load segments thereon;

said plurality of load segments axially moveable between a first, contracted position allowing said wellhead casing hanger to pass through a specified minimum bare and a second, expanded position whereby said wellhead casing hanger is suspended on said plurality of load segments when said plurality of load segments engage an annular groove in a wellhead housing; said plurality of load segments moved between said first, contracted position and said second, expanded position by engagement of an actuation ring with a shoulder in said wellhead housing; and, said plurality of slip segments having a complementary exterior taper to engage said tapered hanger bowl, said plurality of slip segments coaxially moveable with respect to said tapered hanger bowl.

2. A wellhead casing hanger, according to claim 1, wherein: said hanger body may be separated into a plurality of bowl sections to allow installing said wellhead casing hanger around a section of pipe extending through said wellhead housing.

3. A wellhead casing hanger, according to claim 2, wherein: said slip segments included a plurality of teeth formed on the interior and exterior thereof.

4. A wellhead casing hanger, according to claim 3, wherein: said plurality of teeth formed on the interior of said slip segments are beveled to grip a section of pipe extending through said wellhead housing when said slip segments are moved radially inwardly along said tapered hanger bowl.

5. A wellhead casing hanger, according to claim 4, wherein: said plurality of teeth formed on the exterior of said slip segments remain perpendicular to said tapered hanger bowl when said slip segments are moved radially inwardly along said tapered hanger bowl.

6. A wellhead casing hanger, according to claim 5, wherein: said stepped outer shoulder includes a cylindrical retainer surface concentric with the axis of said hanger body; and, said cylindrical retainer surface engages said plurality of load segments to positively retain said plurality of load segments in engagement with said annular groove in said wellhead housing.

7. A wellhead casing hanger, according to claim 6, wherein: said hanger body has a plurality of axially disposed slots formed therein; a retaining means is positioned in each of said plurality of axially disposed slots, said retaining means engages said slip segments; and, said retaining means are moveable within said axially disposed slots in said hanger body to control movement of said slip segments along said tapered hanger bowl and into gripping engagement with said pipe extending through said wellhead housing.

8. A wellhead casing hanger, according to claim 7, wherein: said plurality of load segments includes urging means disposed between adjacent load segments, said urging means urging said plurality of load segments to said first, contracted position.

9. A wellhead casing hanger, according to claim 8, wherein: said urging means are coiled tension springs.

10. A wellhead casing hanger for insertion into a wellhead having an internal shoulder, comprising:

a hanger body, said hanger body having a bore extending therethrough; said hanger body having a stepped outer shoulder, said stepped outer shoulder configured to receive an expandable load ring thereon; said expandable load ring axially moveable between a first, contracted position allowing said wellhead casing hanger to pass through a specified minimum bore and a second, expanded position whereby said wellhead casing hanger is suspended on said expandable load ring when said expandable load ring engages an annular groove in a wellhead housing; and said expandable load ring moved between said first, contracted position and said second, expanded position by engagement with an actuation ring when said actuation ring lands on the internal shoulder of the wellhead.

11. A wellhead casing hanger, according to claim 10, wherein:

said hanger body has an interior thread for attachment of a casing string to be suspended by said wellhead casing hanger.

12. A wellhead casing hanger, according to claim 11, wherein:

said hanger body has a reduced exterior diameter on one end to receive a packoff assembly between said hanger body and said wellhead housing.

13. A wellhead casing hanger, according to claim 12, wherein:

said hanger body has an exterior thread adjacent said reduced exterior diameter for attachment of a running tool.

14. A wellhead casing hanger, according to claim 13, wherein:

said stepped outer shoulder includes a cylindrical retainer surface concentric with the axis of said hanger body; and, said cylindrical retainer surface engages said expandable load ring to positively retain said plurality of load segments in engagement with said annular groove in said wellhead housing.

15. An assembly of a hanger adapted to support a tubular string, together comprising hanger weight, and a wellhead, comprising:

a wellhead having an actuation shoulder in a bore therethrough said actuation shoulder incapable of support of hanger weight, said wellhead further comprising an annular groove;

a hanger comprising a body further comprising an actuating ring configured to engage said actuation shoulder, said body further comprising a taper and an adjacent load ring capable of increasing dimension to enter said annular groove in said wellhead, when pushed against said taper when said hanger is lowered with said actuating ring landed on said actuation shoulder;

whereupon said entering of said load ring into said groove hanger weight can be first supported in said wellhead.

16. The assembly of claim 15, wherein:

said body comprises a thread for support of the tubular string.

17. The assembly of claim 15, wherein:

said body comprises a grapple to selectively grip the tubular string.

18. The assembly of claim 16, wherein:

said grapple comprises a taper surrounding a bore in said body and at least one slip mounted to translate on said taper to selectively grip the tubular string upon relative movement between said slip and said taper.

19. An apparatus for use in wellbores, comprising:

a first tubular member configured for insertion into a wellbore and having first and second external surfaces, the second external surface having a larger diameter than the first external surface;

a continuous load-ring assembly circumscribing the first tubular member and having at least one biasing member to bias the load-ring radially toward the first tubular member; wherein the first external surface defines a retracted radial position of the load-ring and the second external surface defines an expanded radial position of the load-ring to engage the load-ring with respect to a recessed portion of a second tubular member to support the first tubular member with respect to the second tubular member, and wherein the load-ring is axially displaceable with respect to the first tubular member; and an actuation ring disposed radially outboard of and axially displaceable with respect to the first tubular, wherein the actuation ring is configured to engage with an internal shoulder of the second tubular member to at least partially define the axial position of the load-ring with respect to the first tubular member.

20. The apparatus as recited in claim 19, wherein the load-ring comprises a plurality of segments coupled to one another via biasing members.

21. The apparatus as recited in claim 20, wherein the biasing member comprise tension springs.

22. The apparatus as recited in claim 19, wherein the first tubular member comprises a casing hanger.

23. The apparatus as recite in claim 19, wherein the first tubular member comprises a test plug.

* * * * *